US008764579B2

(12) United States Patent
Ban

(10) Patent No.: US 8,764,579 B2
(45) Date of Patent: Jul. 1, 2014

(54) GOLF CLUB HEAD

(75) Inventor: Wataru Ban, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 235 days.

(21) Appl. No.: 13/463,929

(22) Filed: May 4, 2012

(65) Prior Publication Data

US 2012/0302369 A1 Nov. 29, 2012

(30) Foreign Application Priority Data

May 23, 2011 (JP) ..... 2011-115135
May 30, 2011 (JP) ..... 2011-120972

(51) Int. Cl.
*A63B 53/08* (2006.01)

(52) U.S. Cl.
USPC ..... 473/346; 473/344; 473/349; 473/332

(58) Field of Classification Search
USPC ..... 473/346, 344, 349, 332
See application file for complete search history.

(56) References Cited

U.S. PATENT DOCUMENTS

| | | | | |
|---|---|---|---|---|
| 6,595,871 | B2 * | 7/2003 | Sano | 473/342 |
| 6,949,031 | B2 | 9/2005 | Imamoto et al. | |
| 7,273,423 | B2 | 9/2007 | Imamoto | |
| 7,390,271 | B2 | 6/2008 | Yamamoto | |
| 7,507,168 | B2 * | 3/2009 | Chou et al. | 473/346 |
| 7,563,175 | B2 | 7/2009 | Nishitani et al. | |
| 7,775,907 | B2 * | 8/2010 | Hirano | 473/349 |
| 7,806,781 | B2 | 10/2010 | Imamoto | |
| 8,246,489 | B2 * | 8/2012 | Yamamoto | 473/346 |
| 2002/0022535 | A1 * | 2/2002 | Takeda | 473/346 |
| 2008/0214322 | A1 * | 9/2008 | Chou et al. | 473/346 |
| 2010/0022327 | A1 * | 1/2010 | Nakano | 473/346 |

FOREIGN PATENT DOCUMENTS

| | | | |
|---|---|---|---|
| JP | 2569340 | B2 | 4/1989 |
| JP | 9-99121 | A | 4/1997 |
| JP | 9-248353 | A | 9/1997 |
| JP | 3635227 | B2 | 12/2001 |
| JP | 4222034 | B2 | 8/2004 |
| JP | 2005-160947 | A | 6/2005 |
| JP | 4378298 | B2 | 8/2006 |
| JP | 2008-173293 | A | 7/2008 |
| JP | 2010-234108 | A | 10/2010 |
| JP | 2011-62255 | A | 3/2011 |

* cited by examiner

*Primary Examiner* — Benjamin Layno
(74) *Attorney, Agent, or Firm* — Sughrue Mion, PLLC

(57) ABSTRACT

A hollow golf club head according to this invention includes a face portion, a crown portion, and a sole portion, and is formed by connecting a plurality of shell members to each other. This golf club head includes a rib which is provided in the sole portion and used to adjust an impact sound. The plurality of shell members are divided using at least the rib as a boundary. The plurality of shell members include a rib forming shell member including a sole portion forming portion which forms part of the sole portion, and a rib forming portion which stands upright from the end of the sole portion forming portion and forms the rib.

22 Claims, 16 Drawing Sheets

GOLF CLUB HEAD

BACKGROUND OF THE INVENTION

1. Field of the Invention

The present invention relates to a hollow golf club head.

2. Description of the Related Art

In hollow golf club heads typified by a driver head, their volumes are increasing every year, so their crown portions and sole portions are getting thinner, and the areas of these crown and sole portions are increasing along with this trend. Hence, techniques for reducing the weights of golf club heads have been proposed (for example, Japanese Patent Laid-Open Nos. 9-99121 and 9-248353).

On the other hand, with an increase in head volume, a low-pitched impact sound is more likely to be generated at the time of striking a golf ball. Under the circumstance, golfers who prefer high-pitched impact sounds want golf club heads which generate higher-pitched impact sounds. As a strategy of increasing the pitch of an impact sound, a strategy of increasing the natural frequency of the head by providing a rib on the sole portion is available (for example, Japanese Patent Laid-Open No. 2011-62255).

As a method of forming a rib for adjusting an impact sound, as described above, it is possible to form a head and a rib as separate members and weld the rib to the sole portion of the head. However, because such a rib is normally a small component, it is troublesome to align and hold the sole portion and the rib in preparations for welding, leading to poor operating performance.

SUMMARY OF THE INVENTION

It is an object of the present invention to more easily form a rib for adjusting an impact sound.

According to the first aspect of the present invention, there is provided a hollow golf club head which includes a face portion, a crown portion, and a sole portion, and is formed by connecting a plurality of shell members to each other, the head comprising: a rib which is provided in the sole portion and used to adjust an impact sound, wherein the plurality of shell members are divided using at least the rib as a boundary, the plurality of shell members include a rib forming shell member, and the rib forming shell member comprises: a sole portion forming portion which forms part of the sole portion; and a rib forming portion which stands upright from an end of the sole portion forming portion and forms the rib.

According to the second aspect of the present invention, there is provided a hollow golf club head which includes a face portion, a crown portion, and a sole portion, and is formed by connecting a plurality of shell members to each other, the head comprising: a rib which is provided in the crown portion and used to adjust an impact sound, wherein the plurality of shell members are divided using at least the rib as a boundary, the plurality of shell members include a rib forming shell member, and the rib forming shell member comprises: a crown portion forming portion which forms part of the crown portion; and a rib forming portion which stands upright from an end of the crown portion forming portion and forms the rib.

According to the third aspect of the present invention, there is provided a hollow golf club head which includes a face portion, a crown portion, and a sole portion, and is formed by connecting a plurality of shell members to each other, the head comprising: a first rib which is provided in the sole portion and used to adjust an impact sound; and a second rib which is provided in the crown portion and used to adjust an impact sound, wherein the plurality of shell members are divided using at least the first rib and the second rib as boundaries, and the plurality of shell members include a rib forming shell member including a sole portion forming portion which forms part of the sole portion, and a rib forming portion which stands upright from an end of the sole portion forming portion and forms the rib, and a rib forming shell member including a crown portion forming portion which forms part of the crown portion, and a rib forming portion which stands upright from an end of the crown portion forming portion and forms the rib.

According to the fourth aspect of the present invention, there is provided hollow golf club head formed by connecting a plurality of shell members to each other, the head comprising: a rib for adjusting an impact sound, wherein the plurality of shell members are divided using at least the rib as a boundary, and the plurality of shell members include a rib forming shell member including a peripheral wall forming portion which forms part of a peripheral wall of the golf club head, and a rib forming portion which stands upright from an end of the peripheral wall forming portion and forms the rib.

Further features of the present invention will become apparent from the following description of exemplary embodiments with reference to the attached drawings.

DESCRIPTION OF THE EMBODIMENTS

First Embodiment

Figure 1:
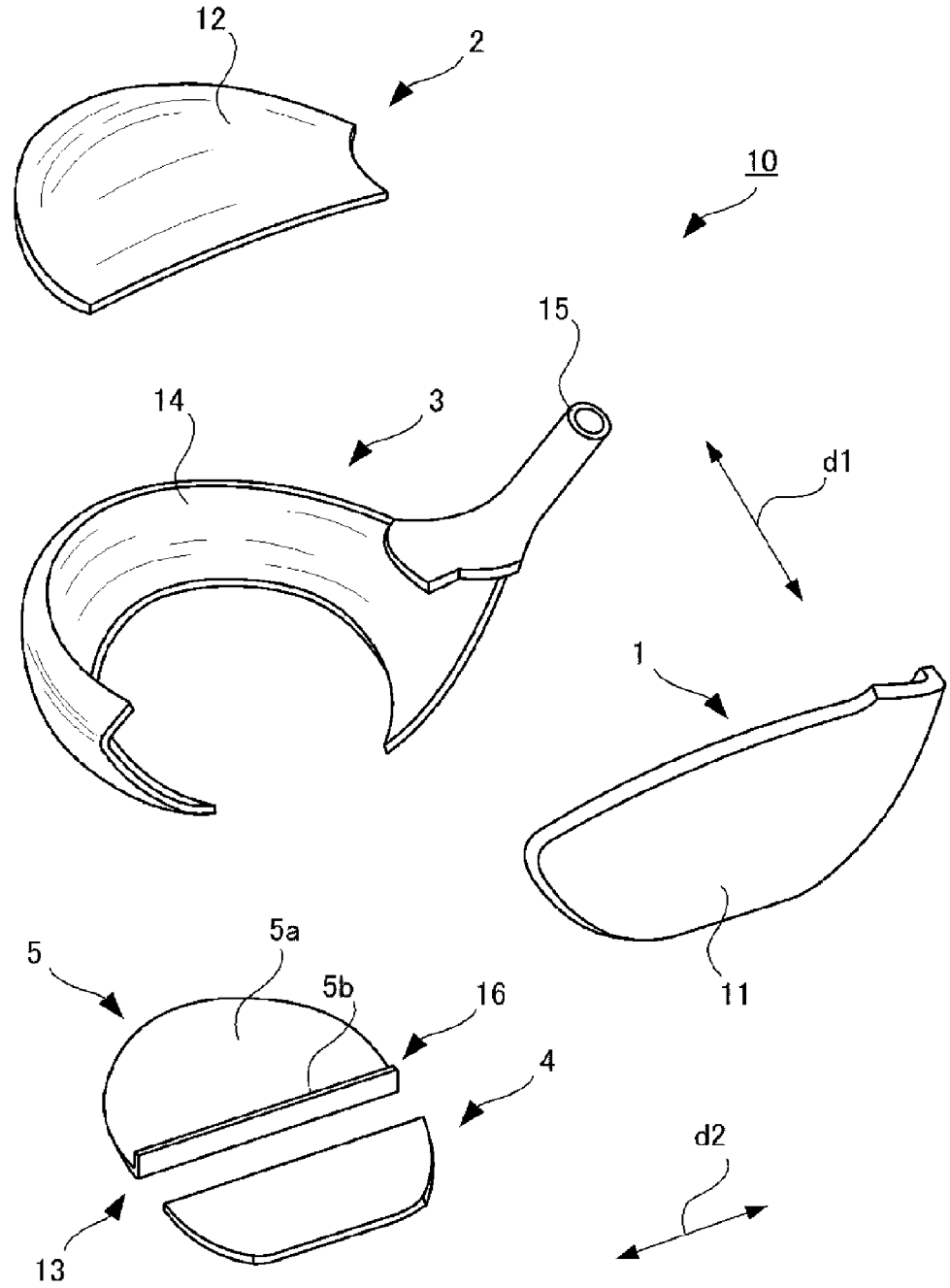
FIG. 1 is an exploded perspective view of a golf club head according to an embodiment of the present invention.
Figure 2:
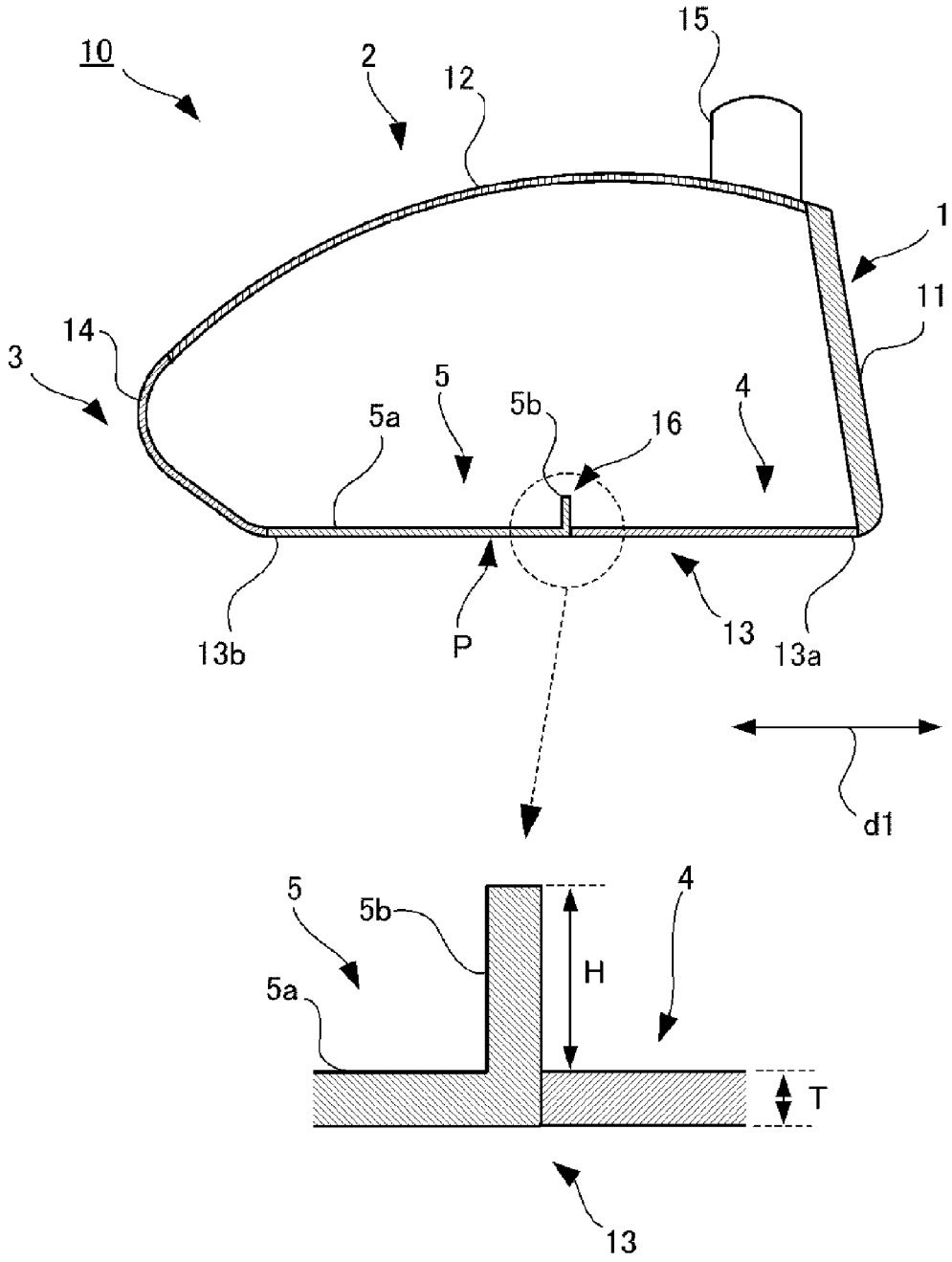
FIG. 2 shows a sectional view and partial enlarged view of the golf club head shown in FIG. 1.

FIG. 1 is an exploded perspective view of a golf club head 10 according to an embodiment of the present invention. FIG. 2 shows a sectional view and partial enlarged view of the golf club head 10 and, more specifically, a sectional view taken along almost the middle of the golf club head 10 in the toe-to-heel direction as a cross-section. Referring to FIGS. 1 and 2, a double-headed arrow d1 indicates the face-to-back direction, and a double-headed arrow d2 indicates the toe-to-heel direction.

Note that the face-to-back direction means a horizontal direction along the flight trajectory direction when the golf club head 10 is grounded at a specific lie angle defined for the golf club head 10, and is normally the direction of a plane perpendicular to the central portion of a face portion 11. The toe-to-heel direction means a horizontal direction perpendicular to the face-to-back direction when the golf club head 10 is grounded at the specific lie angle.

The golf club head 10 takes the form of a hollow body formed by connecting a plurality of shell members 1 to 5 to each other, and its peripheral wall forms the face portion 11 which forms a face surface (striking surface), and a crown portion 12, a sole portion 13, and a side portion 14 which form the upper, bottom, and side portions, respectively. The side portion 14 includes toe-, back-, and heel-side portions. The golf club head 10 also includes a hosel portion 15 in which a shaft is mounted.

A rib 16 for adjusting an impact sound is formed on the inner upper surface of the sole portion 13. In this embodiment, the rib 16 extends from the toe side to the heel side in a band shape so as to traverse the sole portion 13 from the toe side to the heel side.

In general, as the head volume increases, it is necessary to decrease the thickness of the peripheral wall of the head while a required strength is ensured. A thickness T (FIG. 2) of the sole portion 13 is preferably, for example, 0.5 mm (inclusive) to 1.0 mm (inclusive). Note that when the thickness T is to be set relatively large, it is preferably 1.2 mm (inclusive) to 2.5 mm (inclusive).

As the head volume increases, the area of each portion, in turn, increases, so the eigenvalue of the entire head decreases, and the eigenvalue (natural frequency) of the first-order vibration mode of the sole portion 13, in turn, decreases. Therefore, a low-pitched impact sound is more likely to be generated at the time of striking a golf ball in that case. In this embodiment, the sole portion 13 is constrained by providing the rib 16, so the eigenvalue of its first-order vibration mode increases. This makes it possible to increase the pitch of an impact sound.

In this embodiment, an antinode of the first-order vibration mode of the sole portion 13 is assumed to be set at a position P in the face-to-back direction, as shown in FIG. 2, so the rib 16 is placed closer to the position P of an antinode of the first-order vibration mode of the sole portion 13 than a face-side end 13*a* and a back-side end 13*b* of the sole portion 13.

In this manner, the rib 16 is preferably provided near or at the position P of an antinode of the first-order vibration mode of the sole portion 13. This makes it possible to reduce the amplitude of first-order vibration of the sole portion 13, thereby suppressing a decrease in pitch of an impact sound. Note that the position of an antinode of the first-order vibration mode of the sole portion 13 can be obtained by modal analysis using a computer or eigenvalue analysis using the FEM.

A height H (FIG. 2) of the rib 16 from the sole portion 13 is desirably high to a certain degree to improve the effect of constraining the sole portion 13. On the other hand, the height H of the rib 16 may be uniform or vary over the entire rib 16. In either case, the maximum height of the rib 16 from the sole portion 13 is preferably 2.0 mm or more. When the sole portion 13 has, for example, a shape curved in the toe-to-heel direction, the rib 16 has a relatively low height on the toe and heel sides and has a maximum height at the central portion. In this case, the rib 16 preferably has a height of 2.0 mm or more at the central portion of the sole portion 13.

The golf club head 10 is a driver golf club head. However, the present invention is applicable to wood type golf club heads including not only a driver golf club head but also, for example, a fairway wood type golf club head, utility (hybrid) golf club heads, and other hollow golf club heads. The golf club head 10 can be made of a metal material such as a titanium-based metal (for example, 6Al-4V—Ti titanium alloy), stainless steel, or a copper alloy such as beryllium copper.

As a method of connecting the shell members 1 to 5 to each other, welding or adhesion, for example, is available, but welding is preferable in terms of the connection strength. In this embodiment, the shell member 1 forms the face portion 11, the shell member 2 forms the crown portion 12, and the shell member 3 forms part of the peripheral edge portion of the crown portion 12, the side portion 14, and the hosel portion 15.

The sole portion 13 is formed by the shell members 4 and 5 divided using the rib 16 as a boundary. The shell member 5 is a rib forming shell member including a sole portion forming portion 5*a* which forms the portion of the sole portion 13 on the back side, and a rib forming portion 5*b* which stands upright from the end of the sole portion forming portion 5*a* on the side of the face portion 11 and forms the rib 16. The shell member 4 is a sole portion forming shell member, the whole body of which serves as a sole portion forming portion that forms the remaining portion of the sole portion 13 (the portion of the sole portion 13 on the side of the face portion 11).

The shell members 4 and 5 are connected to each other by connecting the end of the shell member 4 on the back side to the end of the sole portion forming portion 5*a* of the shell member 5, as shown in the partial enlarged view of FIG. 2. The ends of the rib forming portion 5*b* on the toe and heel sides need not always be connected to the side portion 14. However, connecting the ends of the rib forming portion 5*b* on the toe and heel sides to the side portion 14 makes it possible to further enhance the magnitude of a constraint force which is produced by the rib 16 and acts on the sole portion 13.

If a method of forming the sole portion 13 and the rib 16 as separate members and connecting them to each other is employed as a method of forming the rib 16, a troublesome process of aligning and holding these separate members is necessary. In this embodiment, the shell member 5 includes the integrated, sole portion forming portion 5*a* and rib forming portion 5*b*, thereby omitting such a troublesome process so as to more easily form the rib 16 for adjusting an impact sound.

In this embodiment, not only the sole portion forming portion 5*a* and rib forming portion 5*b* are integrated but also the rib forming portion 5*b* stands upright from the end of the sole portion forming portion 5*a*. Hence, the shell member 5 can be formed by bending a plate material, that is, it can be formed by forging. This is greatly advantageous in easily forming the shell member 5 with a small thickness.

As described above, as the head volume increases, it is necessary to decrease the thickness of the peripheral wall of the head. If casting is adopted as a manufacturing method, it is often difficult to decrease the thicknesses of the sole portion 13 and rib 16 due to factors associated with the molten metal fluidity and the generation of blowholes. Even if forging is adopted, a method of forming the sole portion 13 and rib 16 as separate members and connecting them to each other requires a troublesome process, as described above. In this embodiment, not only the sole portion forming portion 5*a* and rib forming portion 5*b* are integrated but also the rib forming portion 5*b* stands upright from the end of the sole portion forming portion 5*a*, thereby forming a shell member 5 with a smaller thickness despite the adoption of forging.

In terms of forming thin shell members, all the shell members 1 to 5 are preferably forged but only some of them may be forged. Even if some of the shell members 1 to 5 are forged, at least a shell member (the shell members 4 and 5 in this embodiment) which forms the sole portion 13, and a shell member (the shell member 1 in this embodiment) which forms the face portion 11 are preferably forged because the formed golf club head 10 is required to attain a given precision.

Although the golf club head 10 is formed by the five shell members 1 to 5 in this embodiment, the number of divided shell members is not limited to this, and the shell members need only be divided using at least the rib 16 as a boundary. Therefore, in this embodiment, the golf club head 10 can also be formed by, for example, two shell members at a minimum.

Second Embodiment

Figure 3A:
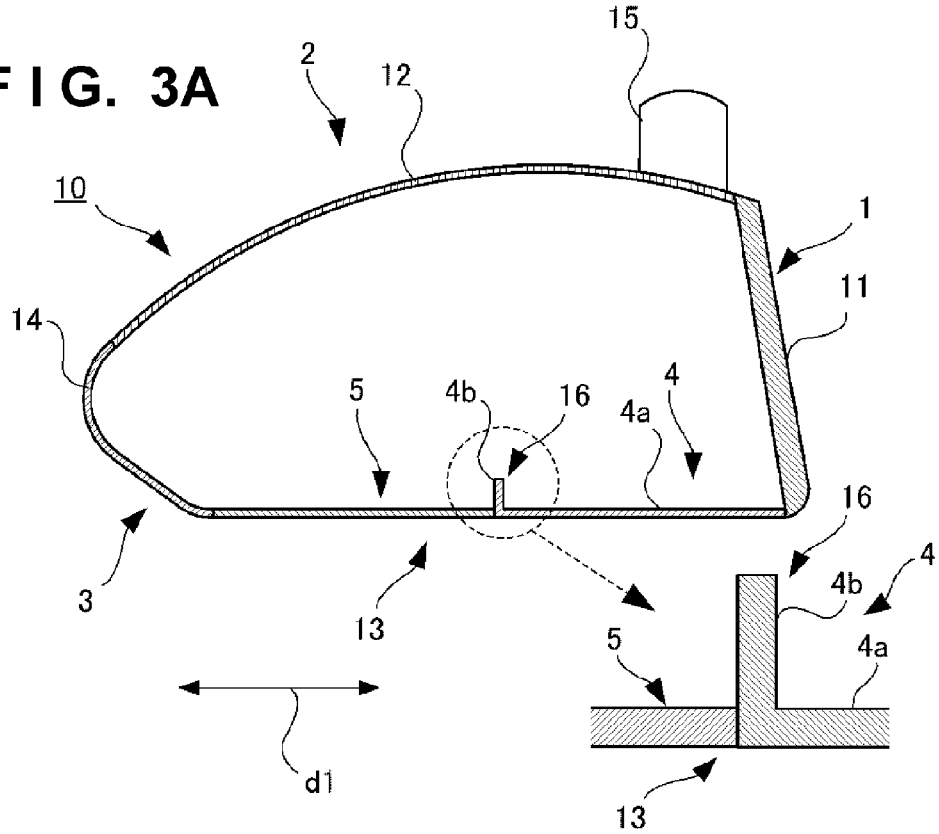
FIGS. 3A and 3B show sectional views and partial enlarged views of a golf club head according to another embodiment.

Although the rib forming portion 5*b* is provided in the shell member 5 which forms the portion of the sole portion 13 on the back side to form the rib 16 in the above-mentioned first embodiment, a rib forming portion may be provided in the shell member 4 which forms the portion of the sole portion 13 on the side of the face portion 11. FIG. 3A illustrates an example of the latter case, in which a shell member 4 is a rib forming shell member including a sole portion forming portion 4*a* and a rib forming portion 4*b* which stands upright from the end of the sole portion forming portion 4*a* on the back side and forms a rib 16. A shell member 5 is a sole portion forming shell member, the whole body of which serves as a sole portion forming portion that forms the remaining portion of a sole portion 13 (the portion of the sole portion 13 on the back side). The shell members 4 and 5 are connected to each other by connecting the end of the shell member 5 on the side of a face portion 11 to the end of the sole portion forming portion 4*a* of the shell member 4.

Figure 3B:
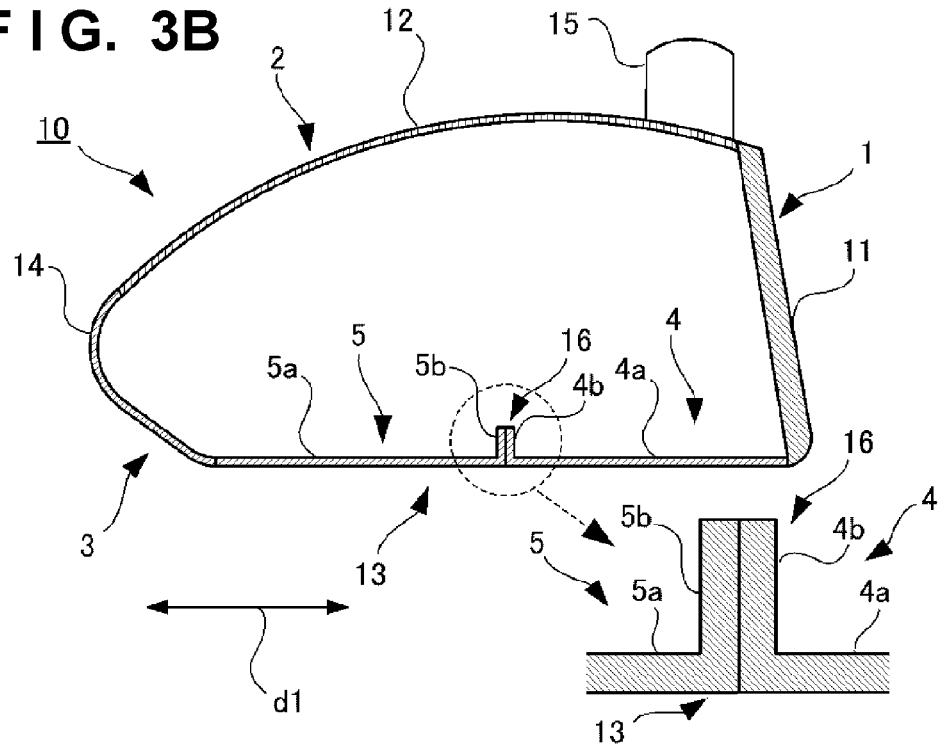

Alternatively, rib forming portions may be provided in both the shell members 4 and 5. FIG. 3B illustrates an example of this case, in which shell members 4 and 5 are rib forming shell members including sole portion forming portions 4*a* and 5*a*, respectively, and rib forming portions 4*b* and 5*b*, respectively. The shell members 4 and 5 are connected to each other by connecting the ends of the sole portion forming portions 4*a* and 5*a* to each other, and connecting the rib forming portions 4*b* and 5*b* to each other, so the rib forming portions 4*b* and 5*b* form one rib 16.

Third Embodiment

Although a single rib 16 is provided on the sole portion 13 in the above-mentioned first embodiment, a plurality of ribs 16 may be provided on the sole portion 13. In the latter case, the golf club head 10 need only be divided into shell members using at least each rib as a boundary, and rib forming shell members need only be present in a number equal to the number of ribs.

Figure 4:
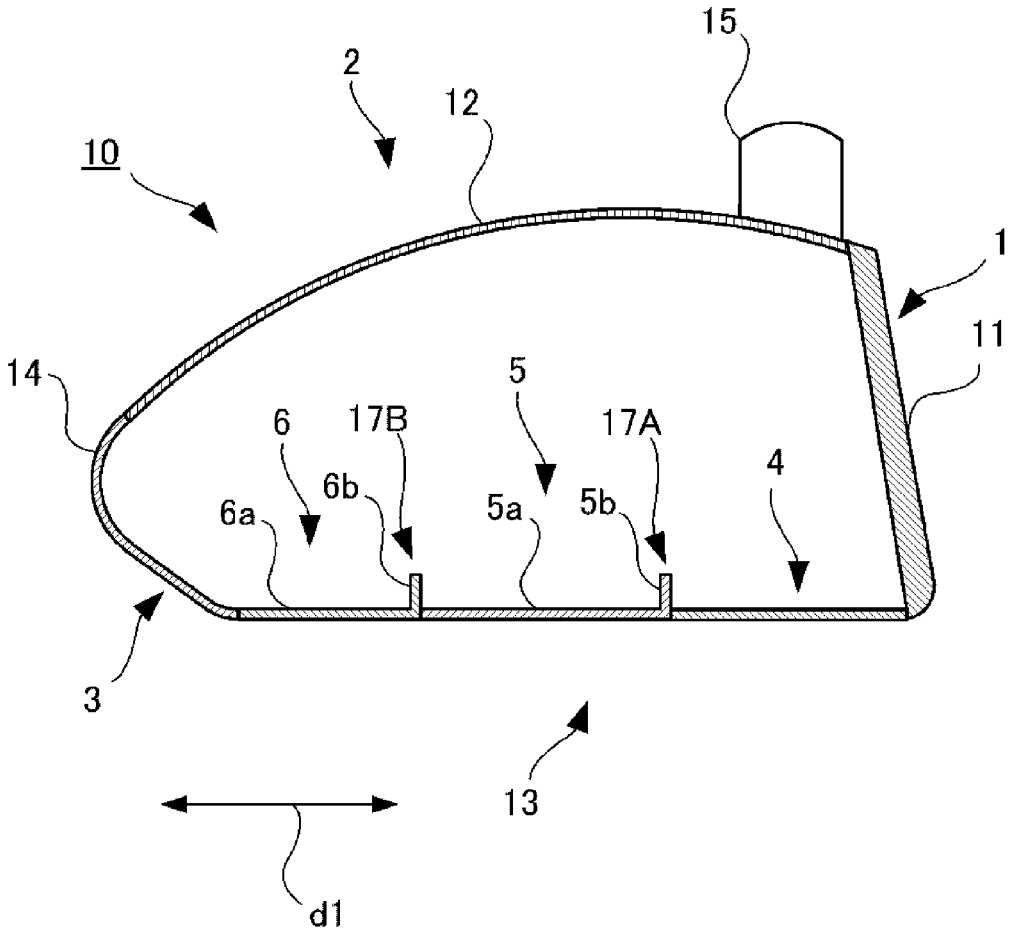
FIG. 4 is a sectional view of a golf club head according to still another embodiment.

FIG. 4 illustrates an example of that case. In the example shown in FIG. 4, two ribs 17A and 17B are provided on a sole portion 13. The ribs 17A and 17B have the same configuration as the above-mentioned rib 16 but are spaced apart from each other in the face-to-back direction. The sole portion 13 is divided into three shell members 4 to 6 using the ribs 17A and 17B as boundaries.

The shell member 4 is a sole portion forming shell member, the whole body of which serves as a sole portion forming portion that forms the portion of the sole portion 13 on the side of a face portion 11. The shell member 5 is a rib forming shell member including a sole portion forming portion 5*a* and a rib forming portion 5*b* which stands upright from the end of the sole portion forming portion 5*a* on the side of the face portion 11 and forms the rib 17A. The shell member 6 is a rib forming shell member including a sole portion forming portion 6*a* and a rib forming portion 6*b* which stands upright from the end of the sole portion forming portion 5*a* on the side of the face portion 11 and forms the rib 17B.

The shell members 4 to 6 are connected to each other by connecting the end of the sole portion forming portion 5*a* of the shell member 5 on the side of the face portion 11 to the end of the sole portion forming portion 4*a* of the shell member 4, and connecting the end of the sole portion forming portion 6*a* of the shell member 6 on the side of the face portion 11 to the end of the sole portion forming portion 5*a* of the shell member 5 on the back side.

Fourth Embodiment

Although the sole portion 13 is assumed to be nearly flat in the above-mentioned first embodiment, it may take the form of an arc or elliptic arc curved in the toe-to-heel direction. In the latter case, when the shell member 5 is formed by forging a plate material, the rib forming portion 5*b* may deform in a meandering shape or hamper forging. Hence, slits may be formed in the rib forming portion 5*b* in advance.

Figure 5A:
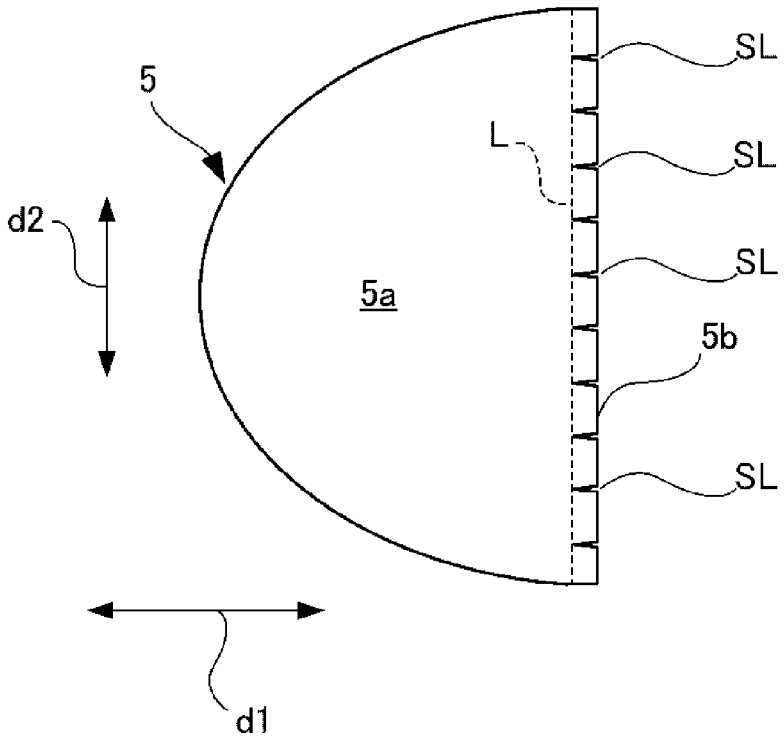
FIG. 5A illustrates an example of an exploded view of a shell member.

FIG. 5A illustrates an example of an exploded view of a shell member 5, which is assumed to be bent along a bend line L so that a rib forming portion 5*b* stands upright from a sole portion forming portion 5*a*. Also, the sole portion forming portion 5*a* is assumed to be formed so as to curve in the toe-to-heel direction. A plurality of wedged slits SL are formed in the rib forming portion 5*b* with gaps between them in the toe-to-heel direction.

Figure 5B:
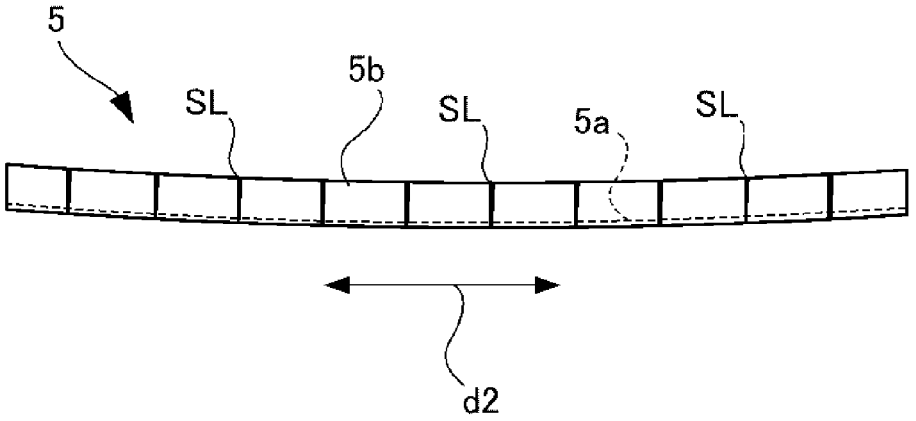
FIG. 5B illustrates an example of the configuration of a rib when the sole portion is curved.

FIG. 5B is a view illustrating the forged shell member 5 when viewed in the face-to-back direction. The shell member 5 is curved in the toe-to-heel direction as a whole, so deformation of the rib forming portion 5*b* is absorbed by the slits SL. This prevents the rib forming portion 5*b* from deforming in a meandering shape or hampering forging. Note that small pieces of the rib forming portion 5*b* may be connected to each other so that the slits SL are filled.

Fifth Embodiment

Although the rib 16 traverses the sole portion 13 in the above-mentioned first embodiment, it can adopt various shapes and arrangements.

Figure 6:
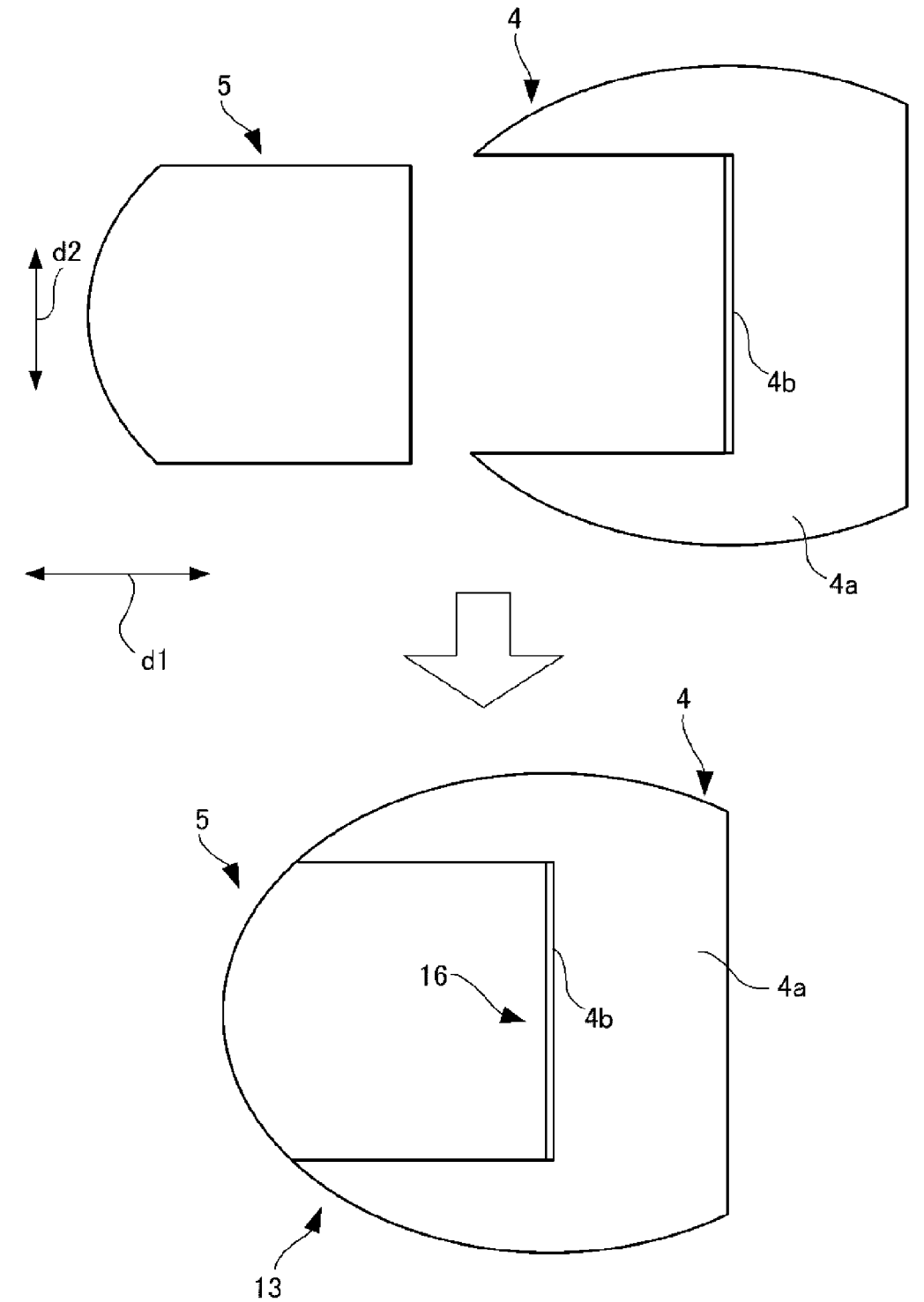
FIG. 6 is a view illustrating an example of divided shell members.

FIG. 6 illustrates an example in which a rib 16 does not traverse a sole portion 13. In the example shown in FIG. 6, a line along which the shell members are divided is absent on the extension of the rib. Shell members 4 and 5 different from those in the above-mentioned first embodiment are shown in FIG. 6, and form the sole portion 13. FIG. 6 shows the shell members 4 and 5 in a divided state on the upper side, and those in a connected state on the lower side.

In the example shown in FIG. 6, the rib 16 does not traverse the sole portion 13 in the toe-to-heel direction, and extends from the toe side to the heel side at its central portion. The shell member 4 includes a sole portion forming portion 4*a* which forms the portion of the sole portion 13 on the side of a face portion 11 and the toe- and heel-side portions of the sole portion 13 on the back side. Also, the shell member 4 is a rib forming shell member including a rib forming portion 4*b* which stands upright from the end of the sole portion forming portion 4*a* on the back side at the center of the sole portion 13 and forms the rib 16. The shell member 5 is a sole portion forming shell member, the whole body of which serves as a sole portion forming portion that forms the remaining portion of the sole portion 13 (the central portion of the sole portion 13 on the back side).

The shell members 4 and 5 are connected to each other by connecting the end of the shell member 5 on the side of the face portion 11 and the ends of the shell member 5 on the toe and heel sides to the shell member 4.

Figure 7:
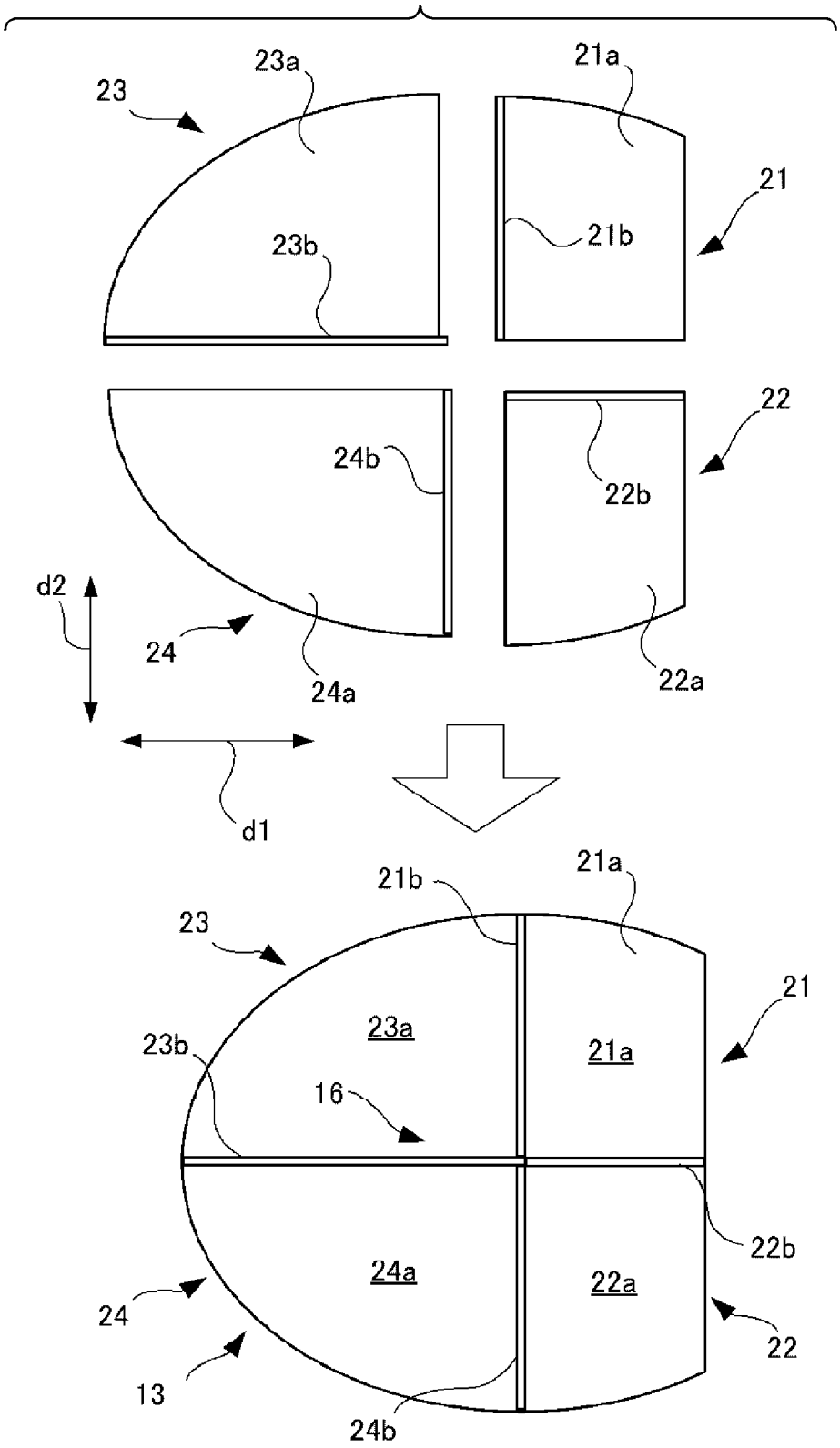
FIG. 7 is a view illustrating another example of divided shell members.

FIG. 7 illustrates an example in which a rib 16 is formed in a cross shape. In the example shown in FIG. 7, a sole portion 13 is formed by four shell members 21 to 24. FIG. 7 shows the shell members 21 to 24 in a divided state on the upper side, and those in a connected state on the lower side. The shell members 21 to 24 are rib forming shell members including sole portion forming portions 21*a* to 24*a*, respectively, and rib forming portions 21*b* to 24*b*, respectively. The shell members 21 to 24 are integrated by connecting their adjacent ends to each other.

Sixth Embodiment

Although the entire sole portion 13 is assumed to have a nearly uniform thickness in each of the above-mentioned embodiments, it can also be formed with a thickness which varies in each individual part by varying the thickness of the sole portion forming portion between the shell members.

In, for example, the above-mentioned first embodiment shown in FIGS. 1 and 2, the sole portion 13 is divided into a portion on the side of the face portion 11 (shell member 4) and a portion on the back side (the sole portion forming portion 5*a* of the shell member 5), using the rib 16 as a boundary. For this reason, the use of shell members having different thicknesses as the shell members 4 and 5 makes it possible to vary the thickness of the sole portion 13 between the side of the face portion 11 and the back side, thereby generating differences in strength and weight balance between these two sides.

If the portion of the sole portion 13 on the side of the face portion 11 (shell member 4) has a relatively large thickness, and the portion of the sole portion 13 on the back side (the sole portion forming portion 5*a* of the shell member 5) has a relatively small thickness, the support stiffness of the lower portion of the face portion 11 can be improved, thereby increasing the launch angle of a struck ball.

In contrast, if the portion of the sole portion 13 on the side of the face portion 11 (shell member 4) has a relatively small thickness, and the portion of the sole portion 13 on the back side (the sole portion forming portion 5*a* of the shell member 5) has a relatively large thickness, the portion of the sole portion 13 on the back side can be made relatively heavy, thereby increasing the center-of-gravity depth.

Figure 8A:
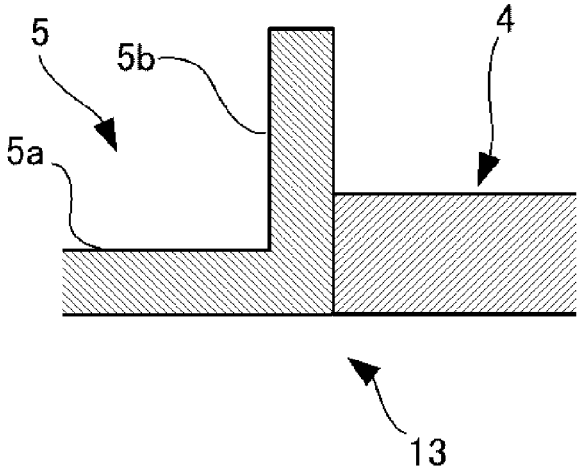
FIGS. 8A and 8B are views illustrating examples of connected shell members having different thicknesses.
Figure 8B:
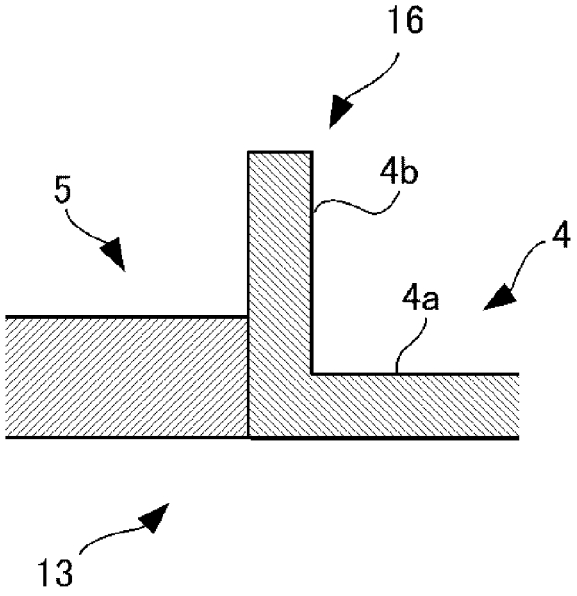

When shell members having different thicknesses are used, a shell member including a rib forming portion preferably has a relatively small thickness. FIG. 8A illustrates an example in which the shell member 5 which forms the portion of the sole portion 13 on the back side is provided with a rib forming portion 5*b* and made thinner than the shell member 4 which forms the portion of the sole portion 13 on the side of the face portion 11. Also, FIG. 8B illustrates an example in which the shell member 4 which forms the portion of the sole portion 13 on the side of the face portion 11 is provided with a rib forming portion 4*b* and made thinner than the shell member 5 which forms the portion of the sole portion 13 on the back side.

The use of a shell member having a relatively small thickness as a shell member including a rib forming portion is advantageous in easily forming (in easily bending) the rib forming portion when shell members are formed by, for example, press molding. Also, when the shell members are to be connected to each other by welding, this can be done more satisfactorily.

Seventh Embodiment

Figure 9:
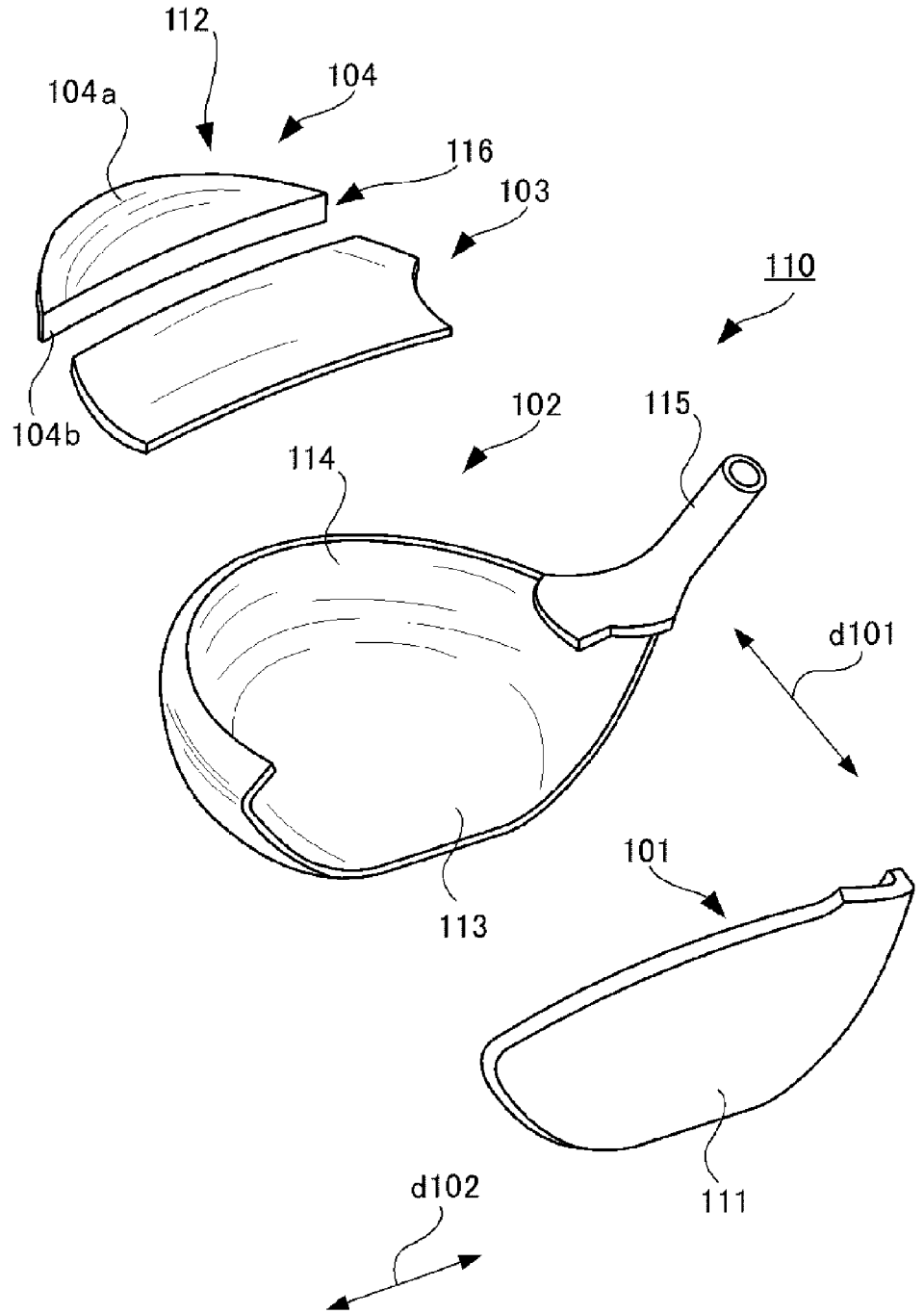
FIG. 9 is an exploded perspective view of a golf club head according to still another embodiment.
Figure 10:
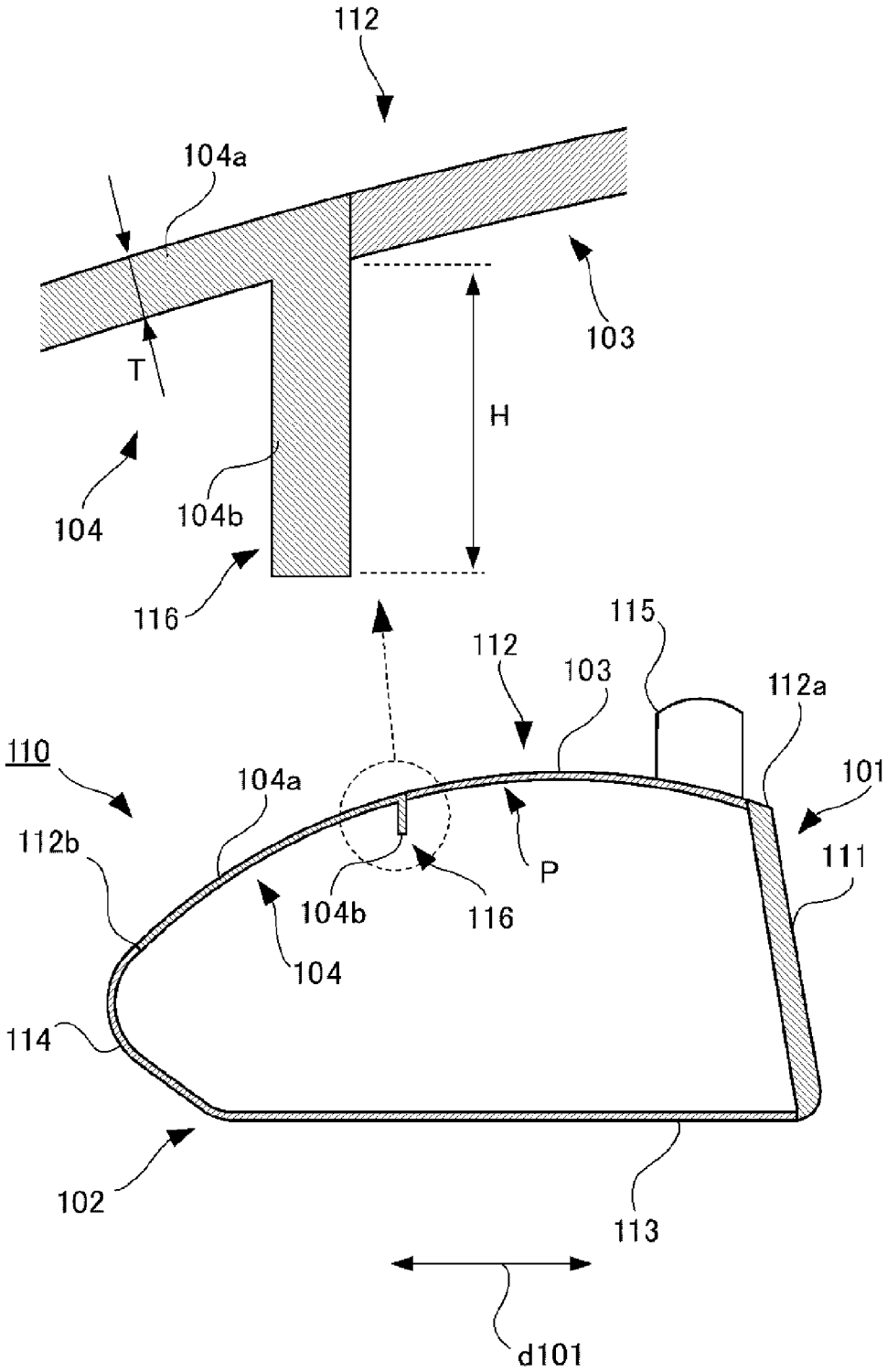
FIG. 10 shows a sectional view and partial enlarged view of the golf club head shown in FIG. 9.

FIG. 9 is an exploded perspective view of a golf club head 110 according to another embodiment of the present invention. FIG. 10 shows a sectional view and partial enlarged view of the golf club head 110 and, more specifically, a sectional view taken along almost the middle of the golf club head 110 in the toe-to-heel direction as a cross-section. Referring to FIGS. 9 and 10, a double-headed arrow d101 indicates the face-to-back direction, and a double-headed arrow d102 indicates the toe-to-heel direction.

Note that the face-to-back direction means a horizontal direction along the flight trajectory direction when the golf club head 110 is grounded at a specific lie angle defined for the golf club head 110, and is normally the direction of a plane perpendicular to the central portion of a face portion 111. The toe-to-heel direction means a horizontal direction perpendicular to the face-to-back direction when the golf club head 110 is grounded at the specific lie angle.

The golf club head 110 takes the form of a hollow body formed by connecting a plurality of shell members 101 to 104 to each other, and its peripheral wall forms the face portion 111 which forms a face surface (striking surface), and a crown portion 112, a sole portion 113, and a side portion 114 which form the upper, bottom, and side portions, respectively. The side portion 114 includes toe-, back-, and heel-side portions. The golf club head 110 also includes a hosel portion 115 in which a shaft is mounted.

A rib 116 for adjusting an impact sound is formed on the inner lower surface of the crown portion 112. In this embodiment, the rib 116 extends from the toe side to the heel side in a band shape.

In general, as the head volume increases, it is necessary to decrease the thickness of the peripheral wall of the head while a required strength is ensured. A thickness T (FIG. 10) of the crown portion 112 is preferably, for example, 0.3 mm (inclusive) to 1.0 mm (inclusive). Note that when the thickness T is to be set relatively large, it is preferably 1.2 mm (inclusive) to 2.5 mm (inclusive).

As the head volume increases, the area of each portion, in turn, increases, so the eigenvalue of the entire head decreases, and the eigenvalue (natural frequency) of the first-order vibration mode of the crown portion 112, in turn, decreases. Therefore, a low-pitched impact sound is more likely to be generated at the time of striking a golf ball in that case. In this embodiment, the crown portion 112 is constrained by providing the rib 116, so the eigenvalue of its first-order vibration mode increases. This makes it possible to increase the pitch of an impact sound.

In this embodiment, an antinode of the first-order vibration mode of the crown portion 112 is assumed to be set at a position P in the face-to-back direction, as shown in FIG. 10, so the rib 116 is placed closer to the position P of an antinode of the first-order vibration mode of the crown portion 112 than a face-side end 112*a* and a back-side end 112*b* of the crown portion 112.

In this manner, the rib 116 is preferably provided near or at the position P of an antinode of the first-order vibration mode of the crown portion 112. This makes it possible to reduce the amplitude of first-order vibration of the crown portion 112, thereby suppressing a decrease in pitch of an impact sound. Note that the position of an antinode of the first-order vibration mode of the crown portion 112 can be obtained by modal analysis using a computer or eigenvalue analysis using the FEM.

The golf club head 110 is a driver golf club head. However, the present invention is applicable to wood type golf club heads including not only a driver golf club head but also, for example, a fairway wood type golf club head, utility (hybrid) golf club heads, and other hollow golf club heads. The golf club head 110 can be made of a metal material such as a titanium-based metal (for example, 6Al-4V—Ti titanium alloy), stainless steel, or a copper alloy such as beryllium copper.

As a method of connecting the shell members 101 to 104 to each other, welding or adhesion, for example, is available, but welding is preferable in terms of the connection strength. In this embodiment, the shell member 101 forms the face portion 111, and the shell member 102 forms part of the peripheral edge portion of the crown portion 112, the sole portion 113, the side portion 114, and the hosel portion 115.

The crown portion 112 is formed by the shell members 103 and 104 divided using the rib 116 as a boundary, except for part of its peripheral portion. The shell member 104 is a rib forming shell member including a crown portion forming portion 104*a* which forms the portion of the crown portion 112 on the back side, and a rib forming portion 104*b* which stands upright from the end of the crown portion forming portion 104*a* on the side of the face portion 111 and forms the rib 116. The shell member 103 is a crown portion forming shell member, the whole body of which serves as a crown portion forming portion that forms the remaining portion of the crown portion 112 (the portion of the crown portion 112 on the side of the face portion 111).

The shell members 103 and 104 are connected to each other by connecting the end of the shell member 103 on the back side to the end of the crown portion forming portion 104*a* of the shell member 104, as shown in the partial enlarged view of FIG. 10. The ends of the rib forming portion 104*b* on the toe and heel sides need not always be connected to the side portion 14. However, connecting the ends of the rib forming portion 104*b* on the toe and heel sides to the side portion 114 makes it possible to further enhance the magnitude of a constraint force which is produced by the rib 116 and acts on the crown portion 112.

If a method of forming the crown portion 112 and the rib 116 as separate members and connecting them to each other is employed as a method of forming the rib 116, a troublesome process of aligning and holding these separate members is necessary. In this embodiment, the shell member 104 includes the integrated, crown portion forming portion 104*a* and rib forming portion 104*b*, thereby omitting such a troublesome process so as to more easily form the rib 116 for adjusting an impact sound.

In this embodiment, not only the crown portion forming portion 104*a* and rib forming portion 104*b* are integrated but also the rib forming portion 104*b* stands upright from the end of the crown portion forming portion 104*a*. Hence, the shell member 104 can be formed by bending a plate material, that is, it can be formed by forging. This is greatly advantageous in easily forming the shell member 104 with a small thickness.

As described above, as the head volume increases, it is necessary to decrease the thickness of the peripheral wall of the head. If casting is adopted as a manufacturing method, it is often difficult to decrease the thicknesses of the crown portion 112 and rib 116 due to factors associated with the molten metal fluidity and the generation of blowholes. Even if forging is adopted, a method of forming the crown portion 112 and rib 116 as separate members and connecting them to each other requires a troublesome process, as described above. In this embodiment, not only the crown portion forming portion 104*a* and rib forming portion 104*b* are integrated but also the rib forming portion 104*b* stands upright from the end of the crown portion forming portion 104*a*, thereby forming a shell member 104 with a smaller thickness despite the adoption of forging.

In terms of forming thin shell members, all the shell members 101 to 104 are preferably forged but only some of them may be forged. Even if some of the shell members 101 to 104 are forged, at least a shell member (the shell members 103 and 104 in this embodiment) which forms most of the crown portion 112, and a shell member (the shell member 101 in this embodiment) which forms the face portion 111 are preferably forged because the formed golf club head 110 is required to attain a given precision.

Although the golf club head 110 is formed by the four shell members 101 to 104 in this embodiment, the number of divided shell members is not limited to this, and the shell members need only be divided using at least the rib 116 as a boundary. Therefore, in this embodiment, the golf club head 110 can also be formed by, for example, two shell members at a minimum.

Figure 16A:
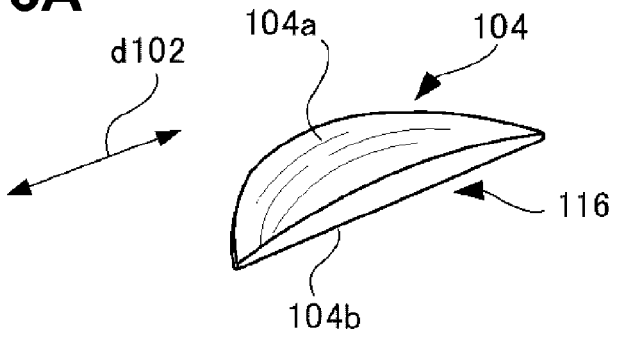
FIG. 16A is a view illustrating another example of a rib.

Note that a height H (FIG. 10) of the rib 116 from the crown portion 112 is desirably high to a certain degree to improve the effect of constraining the crown portion 112. On the other hand, the height H of the rib 116 may be uniform or vary over the entire rib 116. In either case, the maximum height of the rib 116 from the crown portion 112 is preferably 2.0 mm or more. FIG. 16A illustrates an example of the shell member 104 when the height of the rib 116 varies. The rib 116 (rib forming portion 104*b*) has a relatively low height on the toe and heel sides and has a maximum height at the central portion along the curve of the crown portion 112 in the toe-to-heel direction.

Eighth Embodiment

Figure 11A:
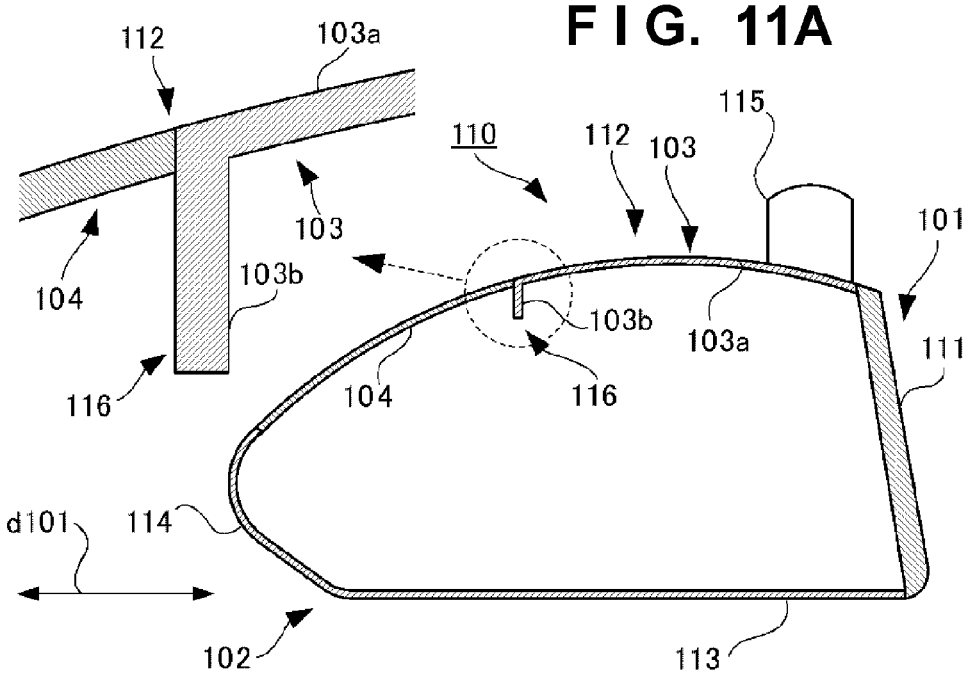
FIGS. 11A and 11B show sectional views and partial enlarged views of a golf club head according to still another embodiment.

Although the rib forming portion 104*b* is provided in the shell member 104 which forms the portion of the crown portion 112 on the back side to form the rib 116 in the above-mentioned seventh embodiment, a rib forming portion may be provided in the shell member 103 which forms the portion of the crown portion 112 on the side of the face portion 111. FIG. 11A illustrates an example of the latter case, in which a shell member 103 is a rib forming shell member including a crown portion forming portion 103*a* and a rib forming portion 103*b* which stands upright from the end of the crown portion forming portion 103*a* on the back side and forms a rib 116. A shell member 104 is a crown portion forming shell member, the whole body of which serves as a crown portion forming portion that forms the remaining portion of a crown portion 112 (the portion of the crown portion 112 on the back side). The shell members 103 and 104 are connected to each other by connecting the end of the shell member 104 on the side of a face portion 111 to the end of the crown portion forming portion 103*a* of the shell member 103.

Figure 11B:
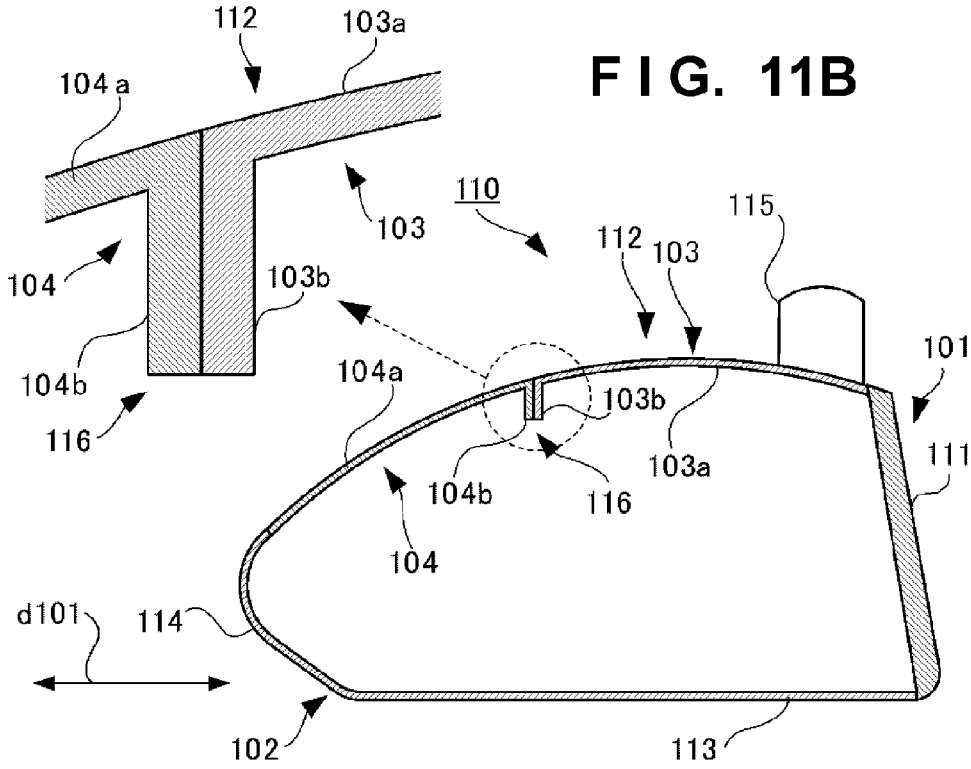

Alternatively, rib forming portions may be provided in both the shell members 103 and 104. FIG. 11B illustrates an example of this case, in which shell members 103 and 104 are rib forming shell members including crown portion forming portions 103*a* and 104*a*, respectively, and rib forming portions 103*b* and 104*b*, respectively. The shell members 103 and 104 are connected to each other by connecting the ends of the crown portion forming portions 103*a* and 104*a* to each other, and connecting the rib forming portions 103*b* and 104*b* to each other, so the rib forming portions 103*b* and 104*b* form one rib 116.

Ninth Embodiment

Although a single rib 116 is provided on the crown portion 112 in the above-mentioned seventh embodiment, a plurality of ribs 116 may be provided on the crown portion 112. In the latter case, the golf club head 110 need only be divided into shell members using at least each rib as a boundary, and rib forming shell members need only be present in a number equal to the number of ribs.

Figure 12:
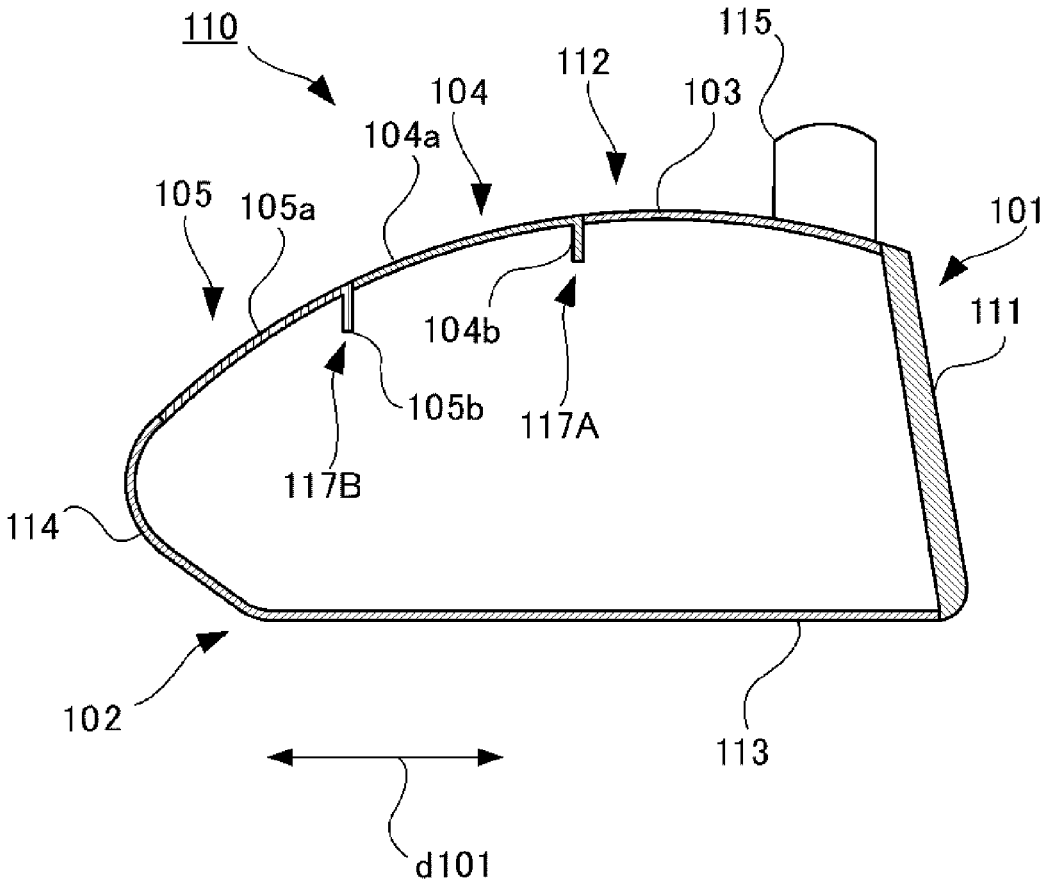
FIG. 12 is a sectional view of a golf club head according to still another embodiment.

FIG. 12 illustrates an example of that case. In the example shown in FIG. 12, two ribs 117A and 117B are provided on a crown portion 112. The ribs 117A and 117B have the same configuration as the above-mentioned rib 116 but are spaced apart from each other in the face-to-back direction. The crown portion 112 is divided into three shell members 103 to 105 using the ribs 117A and 117B as boundaries.

The shell member 103 is a crown portion forming shell member, the whole body of which serves as a crown portion forming portion that forms the portion of the crown portion 112 on the side of a face portion 111. The shell member 104 is a rib forming shell member including a crown portion forming portion 104*a* and a rib forming portion 104*b* which stands upright from the end of the crown portion forming portion 104*a* on the side of the face portion 111 and forms the rib 117A. The shell member 105 is a rib forming shell member including a crown portion forming portion 105*a* and a rib forming portion 105*b* which stands upright from the end of the crown portion forming portion 105*a* on the side of the face portion 111 and forms the rib 117B.

The shell members 103 to 105 are connected to each other by connecting the end of the crown portion forming portion 104*a* of the shell member 104 on the side of the face portion 111 to the end of the shell member 103, and connecting the end of the crown portion forming portion 105*a* of the shell member 105 on the side of the face portion 111 to the end of the crown portion forming portion 104*a* of the shell member 104 on the back side.

10th Embodiment

In the above-mentioned seventh embodiment, the crown portion 112 takes the form of an arc or elliptic arc curved in the toe-to-heel direction. For this reason, when the shell member 104 is formed by forging a plate material, the rib forming portion 104*b* may deform in a meandering shape or hamper forging. Hence, slits may be formed in the rib forming portion 104*b* in advance.

Figure 13A:
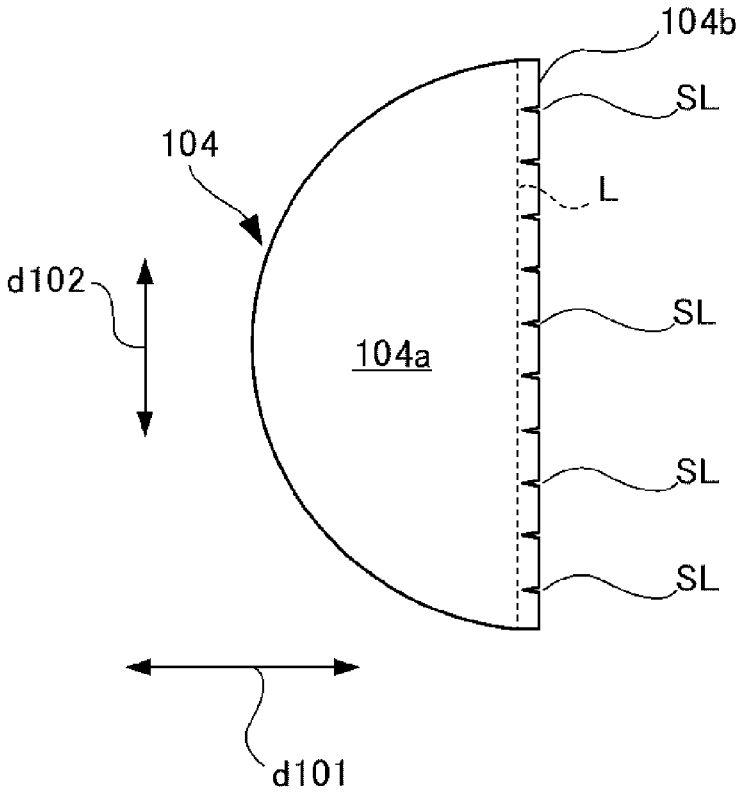
FIG. 13A illustrates an example of an exploded view of a shell member.

FIG. 13A illustrates an example of an exploded view of a shell member 104, which is assumed to be bent along a bend line L so that a rib forming portion 104*b* stands upright from a crown portion forming portion 104*a*. A plurality of wedged slits SL are formed in the rib forming portion 104*b* with gaps between them in the toe-to-heel direction.

Figure 13B:
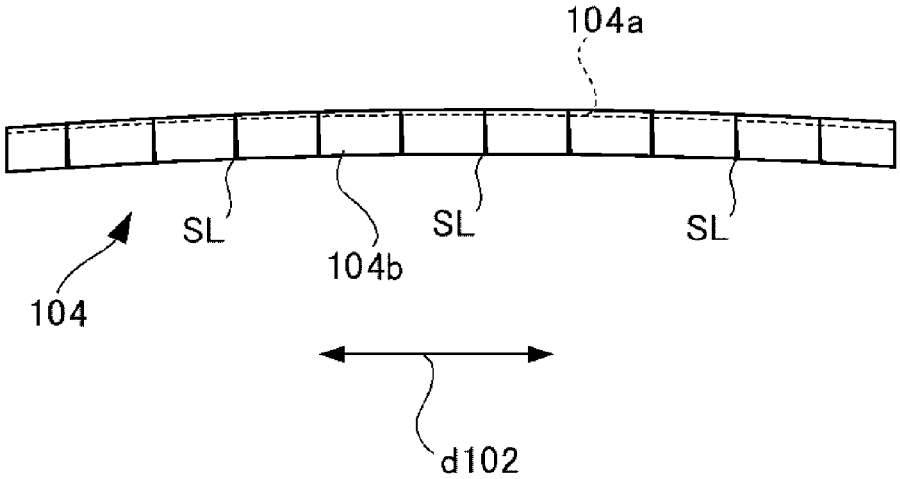
FIG. 13B illustrates an example of the configuration of a rib.

FIG. 13B is a view illustrating the forged shell member 104 when viewed in the face-to-back direction. The shell member 104 is curved in the toe-to-heel direction as a whole, so deformation of the rib forming portion 104*b* is absorbed by the slits SL. This prevents the rib forming portion 104*b* from deforming in a meandering shape or hampering forging. Note that small pieces of the rib forming portion 104*b* may be connected to each other so that the slits SL are filled.

11th Embodiment

Although the rib 116 approximately traverses the crown portion 112 in the above-mentioned seventh embodiment, it can adopt various shapes and arrangements.

Figure 14:
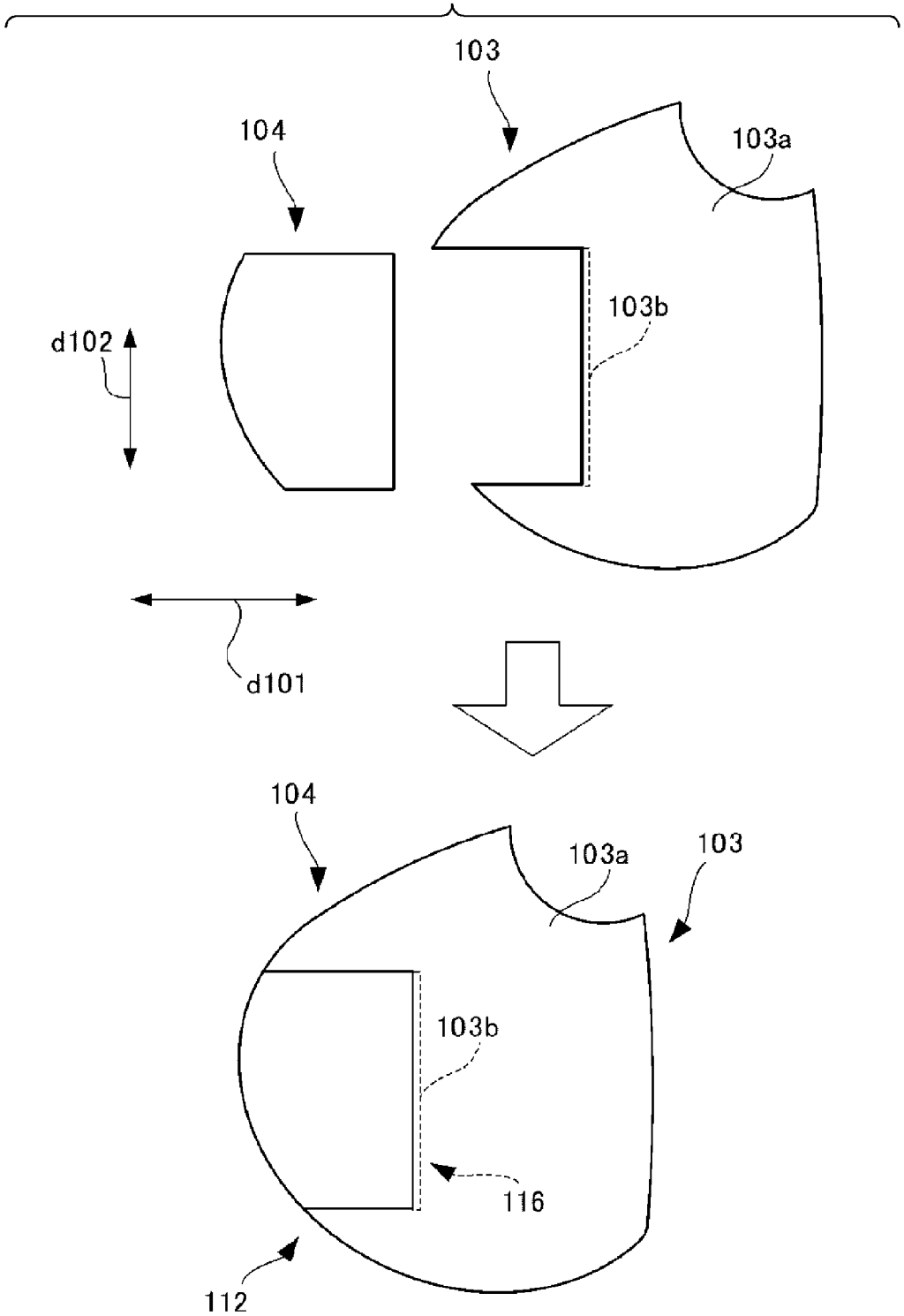
FIG. 14 is a view illustrating an example of divided shell members.

FIG. 14 illustrates an example in which a rib 116 has a shorter length and is provided at the central portion of a crown portion 112 in the toe-to-heel direction. In the example shown in FIG. 14, a line along which the shell members are divided is absent on the extension of the rib. Shell members 103 and 104 different from those in the above-mentioned seventh embodiment are shown in FIG. 14, and form the crown portion 112. FIG. 14 shows the shell members 103 and 104 in a divided state on the upper side, and those in a connected state on the lower side.

In the example shown in FIG. 14, the shell member 103 includes a crown portion forming portion 103*a* which forms the portion of the crown portion 112 on the side of a face portion 111 and the toe- and heel-side portions of the crown portion 112 on the back side. Also, the shell member 103 is a rib forming shell member including a rib forming portion 103*b* which stands upright from the end of the crown portion forming portion 103*a* on the back side at the center of the crown portion 112 and forms the rib 116. The shell member 104 is a crown portion forming shell member, the whole body of which serves as a crown portion forming portion that forms the remaining portion of the crown portion 112 (the central portion of the crown portion 112 on the back side).

The shell members 103 and 104 are connected to each other by connecting the end of the shell member 104 on the side of the face portion 111 and the ends of the shell member 104 on the toe and heel sides to the shell member 103.

Figure 15:
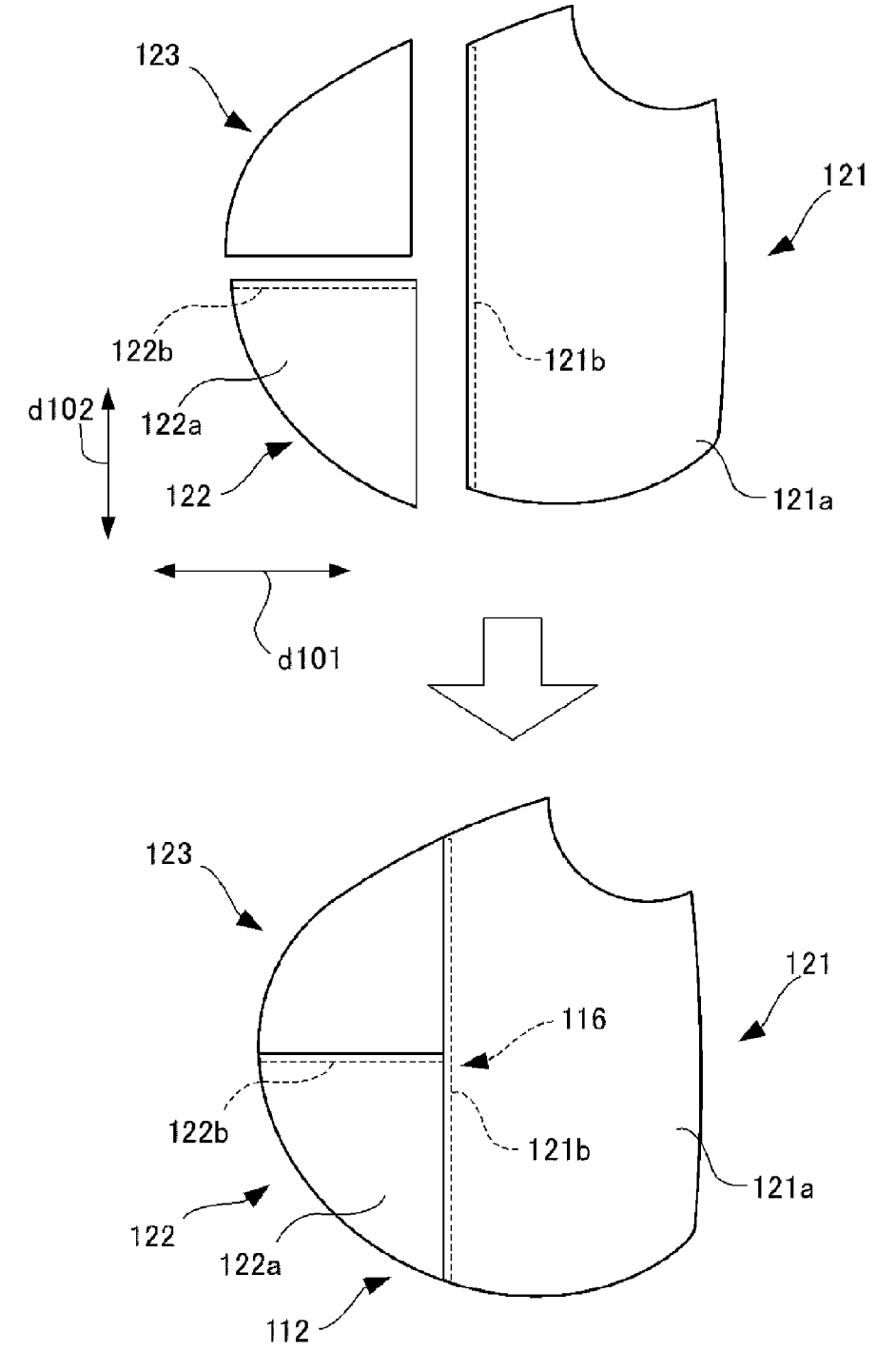
FIG. 15 is a view illustrating another example of divided shell members.

FIG. 15 illustrates an example in which a rib 116 is formed in a T shape. In the example shown in FIG. 15, a crown portion 112 is formed by three shell members 121 to 123. FIG. 15 shows the shell members 121 to 123 in a divided state on the upper side, and those in a connected state on the lower side. The shell members 121 and 122 are rib forming shell members including crown portion forming portions 121*a* and 122*a*, respectively, and rib forming portions 121*b* and 122*b*, respectively. The shell member 123 is a crown portion forming shell member, the whole body of which serves as a crown portion forming portion. The shell members 121 to 123 are integrated by connecting their adjacent ends to each other.

12th Embodiment

Although the entire crown portion 112 is assumed to have a nearly uniform thickness in each of the above-mentioned embodiments, it can also be formed with a thickness which varies in each individual part by varying the thickness of the crown portion forming portion between the shell members.

In, for example, the above-mentioned seventh embodiment shown in FIGS. 9 and 10, the crown portion 112 is divided into a portion on the side of the face portion 111 (shell member 103) and a portion on the back side (the crown portion forming portion 104*a* of the shell member 104), using the rib 116 as a boundary. For this reason, the use of shell members having different thicknesses as the shell members 103 and 104 makes it possible to vary the thickness of the crown portion 112 between the side of the face portion 111 and the back side, thereby generating differences in strength and weight balance between these two sides.

If the portion of the crown portion 112 on the side of the face portion 111 (shell member 103) has a relatively small thickness, and the portion of the crown portion 112 on the back side (the crown portion forming portion 104*a* of the shell member 104) also has a relatively small thickness, the portion of the crown portion 112 on the side of the face portion 111 easily flexes, thereby increasing both the launch angle of a struck ball and the center-of-gravity depth.

Figure 16B:
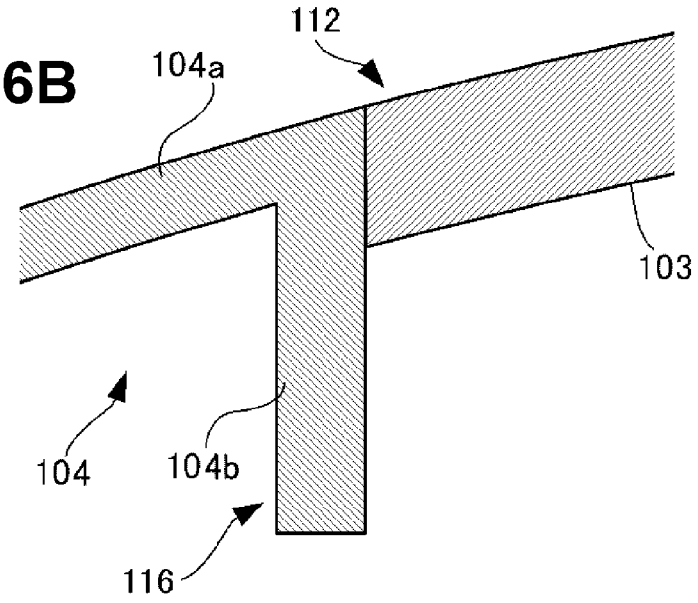
FIGS. 16B and 16C are views illustrating examples of connected shell members having different thicknesses.
Figure 16C:
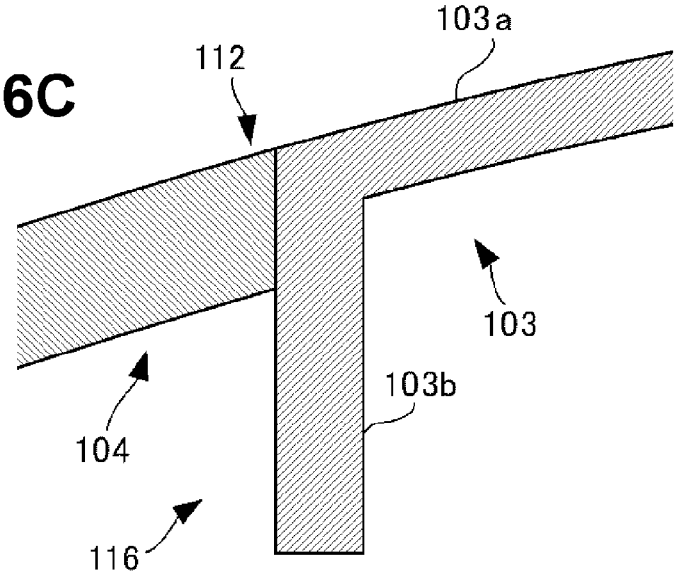

When shell members having different thicknesses are used, a shell member including a rib forming portion preferably has a relatively small thickness. FIG. 16B illustrates an example in which the shell member 104 which forms the portion of the crown portion 112 on the back side is provided with a rib forming portion 104*b* and made thinner than the shell member 103 which forms the portion of the crown portion 112 on the side of the face portion 111. Also, FIG. 16C illustrates an example in which the shell member 103 which forms the portion of the crown portion 112 on the side of the face portion 111 is provided with a rib forming portion 103*b* and made thinner than the shell member 104 which forms the portion of the crown portion 112 on the back side.

The use of a shell member having a relatively small thickness as a shell member including a rib forming portion is advantageous in easily forming (in easily bending) the rib forming portion when shell members are formed by, for example, press molding. Also, when the shell members are to be connected to each other by welding, this can be done more satisfactorily.

Other Embodiments

The above-mentioned first to 12th embodiments can be combined as needed. For example, the golf club head may include the shell member 5 according to the above-mentioned first embodiment and the shell member 104 according to the above-mentioned seventh embodiment so that a rib is formed in each of the crown and sole portions. Also, a rib may be formed in a portion (for example, the side portion) other than the sole portion shown in either of the above-mentioned first to sixth embodiments or the crown portion shown in either of the above-mentioned seventh to 12th embodiments. In these cases as well, a rib can be formed using shell members having the same structure as that shown in either of the above-mentioned first to 12th embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-115135, filed May 23, 2011, and No. 2011-120972, filed May 30, 2011, which are hereby incorporated by reference herein in their entirety.

What is claimed is:

1. A hollow golf club head which includes a face portion, a crown portion, and a sole portion, and is formed by connecting a plurality of shell members to each other, the head comprising:

a rib which is provided in the sole portion and used to adjust an impact sound, wherein the plurality of shell members are divided using at least said rib as a boundary, the plurality of shell members include a rib forming shell member, and said rib forming shell member comprises:

a sole portion forming portion which forms part of the sole portion; and a rib forming portion which stands upright from an end of said sole portion forming portion and forms said rib.

2. The head according to claim 1, wherein said rib forming shell member is forged.

3. The head according to claim 1, wherein the plurality of shell members include a sole portion forming shell member which is connected to said rib forming shell member and includes a sole portion forming portion that forms the remaining part of the sole portion.

4. The head according to claim 1, wherein said sole portion forming portion of said rib forming shell member and said sole portion forming portion of said sole portion forming shell member have different thicknesses.

5. The head according to claim 1, wherein said rib forming shell member includes a first rib forming shell member and a second rib forming shell member, and the single rib is formed by connecting said rib forming portion of said first rib forming shell member and said rib forming portion of said second rib forming shell member to each other.

6. The head according to claim 1, wherein said rib extends from a toe side to a heel side.

7. The head according to claim 1, wherein said rib is closer to a position of an antinode of first-order vibration of the sole portion than an end of the sole portion on a side of the face portion and an end of the sole portion on a back side.

8. The head according to claim 1, wherein the plurality of shell members are connected to each other by welding.

9. The head according to claim 1, wherein said rib is provided at each of a plurality of positions on the sole portion, the plurality of shell members are divided using at least each of said ribs as a boundary, and the plurality of shell members include said rib forming shell members equal in number to said ribs.

10. The head according to claim 1, wherein among the plurality of shell members, at least a shell member including a portion which forms the sole portion, and a shell member including a portion which forms the face portion are forged.

11. A hollow golf club head which includes a face portion, a crown portion, and a sole portion, and is formed by connecting a plurality of shell members to each other, the head comprising:

a rib which is provided in the crown portion and used to adjust an impact sound, wherein the plurality of shell members are divided using at least said rib as a boundary, the plurality of shell members include a rib forming shell member, and said rib forming shell member comprises:

a crown portion forming portion which forms part of the crown portion; and a rib forming portion which stands upright from an end of said crown portion forming portion and forms said rib.

12. The head according to claim 11, wherein said rib forming shell member is forged.

13. The head according to claim 11, wherein the plurality of shell members include a crown portion forming shell member which is connected to said rib forming shell member and includes a crown portion forming portion that forms the remaining part of the crown portion.

14. The head according to claim 11, wherein said crown portion forming portion of said rib forming shell member and said crown portion forming portion of said crown portion forming shell member have different thicknesses.

15. The head according to claim 11, wherein said rib forming shell member includes a first rib forming shell member and a second rib forming shell member, and the single rib is formed by connecting said rib forming portion of said first rib forming shell member and said rib forming portion of said second rib forming shell member to each other.

16. The head according to claim 11, wherein said rib extends from a toe side to a heel side.

17. The head according to claim 11, wherein said rib is closer to a position of an antinode of first-order vibration of the crown portion than an end of the crown portion on a side of the face portion and an end of the crown portion on a back side.

18. The head according to claim 11, wherein the plurality of shell members are connected to each other by welding.

19. The head according to claim 11, wherein said rib is provided at each of a plurality of positions on the crown portion, the plurality of shell members are divided using at least each of said ribs as a boundary, and the plurality of shell members include said rib forming shell members equal in number to said ribs.

20. The head according to claim 11, wherein among the plurality of shell members, at least a shell member including a portion which forms the crown portion, and a shell member including a portion which forms the face portion are forged.

21. A hollow golf club head which includes a face portion, a crown portion, and a sole portion, and is formed by connecting a plurality of shell members to each other, the head comprising:

a first rib which is provided in the sole portion and used to adjust an impact sound; and a second rib which is provided in the crown portion and used to adjust an impact sound, wherein the plurality of shell members are divided using at least said first rib and said second rib as boundaries, and the plurality of shell members include a rib forming shell member including a sole portion forming portion which forms part of the sole portion, and a rib forming portion which stands upright from an end of said sole portion forming portion and forms said rib, and a rib forming shell member including a crown portion forming portion which forms part of the crown portion, and a rib forming portion which stands upright from an end of said crown portion forming portion and forms said rib.

22. A hollow golf club head formed by connecting a plurality of shell members to each other, the head comprising:

a rib for adjusting an impact sound, wherein the plurality of shell members are divided using at least said rib as a boundary, and the plurality of shell members include a rib forming shell member including a peripheral wall forming portion which forms part of a peripheral wall of the golf club head, and a rib forming portion which stands upright from an end of said peripheral wall forming portion and forms said rib.

* * * * *